United States Patent [19]

Ikenoue et al.

[11] 4,128,428

[45] Dec. 5, 1978

[54] HEAT DEVELOPABLE LIGHT-SENSITIVE MATERIAL

[75] Inventors: Shinpei Ikenoue; Takao Masuda; Nobuo Suzuki; Toshiharu Tanaka; Kenji Sashihara, all of Asaka, Japan

[73] Assignee: Fuji Photo Film Co., Ltd., Minami-ashigara, Japan

[21] Appl. No.: 760,792

[22] Filed: Jan. 19, 1977

Related U.S. Application Data

[63] Continuation of Ser. No. 567,026, Apr. 10, 1975, abandoned.

[30] Foreign Application Priority Data

Apr. 10, 1974 [JP] Japan ..... 49-40700

[51] Int. Cl.[2] ..... G03C 1/02; G03C 1/52; G03C 1/66

[52] U.S. Cl. ..... 96/114.1; 96/75; 96/92; 96/93; 96/94 R; 96/114.6

[58] Field of Search ..... 96/114.1, 75, 93, 94, 96/114.6, 92, 109

[56] References Cited

U.S. PATENT DOCUMENTS

| | | | |
|---|---|---|---|
| Re. 27,375 | 5/1972 | Puerckhauer et al. | 96/114.1 |
| 3,094,417 | 6/1963 | Workman | 96/114.1 X |
| 3,147,134 | 9/1964 | Clark | 96/114.1 |
| 3,429,706 | 2/1969 | Sheppard et al. | 96/114.1 |
| 3,457,075 | 7/1969 | Morgan et al. | 96/67 |
| 3,460,964 | 8/1969 | Dunham | 96/114.1 |
| 3,635,719 | 1/1972 | Ohkubo et al. | 96/114.1 |
| 3,870,523 | 3/1975 | Ikenoue et al. | 96/114.1 |
| 3,957,493 | 5/1976 | Masuda et al. | 96/114.1 |
| 4,002,479 | 1/1977 | Suzuki et al. | 96/114.1 |

*Primary Examiner*—Edward C. Kimlin
*Assistant Examiner*—A. T. Suro Picó
*Attorney, Agent, or Firm*—Sughrue, Rothwell, Mion, Zinn and Macpeak

[57] ABSTRACT

A heat developable light-sensitive material comprising a support with at least one layer thereon and containing at least (a) an organic silver salt, (b) light-sensitive silver halide or a silver halide-forming component and (c) a reducing agent with (d) an iron family compound in at least one layer on the support.

23 Claims, No Drawings

HEAT DEVELOPABLE LIGHT-SENSITIVE MATERIAL

This is a continuation of application Ser. No. 567,026, filed Apr. 10, 1975, now abandoned.

BACKGROUND OF THE INVENTION

1. Field of the Invention

The present invention relates to a heat-developable light-sensitive material, and more particularly, it is concerned with a heat developable light-sensitive material which is practically free from thermal fog (undesirable fog resulting from the heating of an exposed heat-developable light-sensitive material).

2. Description of the Prior Art

Silver halide photography has been much more universally employed in the past, compared with electrophotography, diazo photography and the like, because of the superior photographic characteristics such as sensitivity, gradation, etc., of silver halide photography. However, silver halide photography requires much time and labor, because the silver halide light-sensitive material employed in this method must be subjected to several processings including an image-exposure, a developing process using a developer and processes for preventing the developed image from changing color or deteriorating under normal room-illumination and preventing the non-developed portion (hereinafter background) from blackening, e.g., processing including stop, fixation, washing and rinsing, stabilizing and other similar processes. In addition, the chemical agents which may be used in this method are dangerous to the human body, and the processing room and the workers' hands and clothes are often stained with these agents. Therefore, it has been strongly desired to improve silver halide photography so that the light-sensitive materials can be treated in a dry condition instead of treatment with solutions, and so that the processed images are maintained stable. In order to solve this problem, many efforts have been made.

A first method which has been developed thus far includes the so-called combined developing and fixing bath method wherein two procedures in a conventional silver halide photography, developing and fixing procedures, can be replaced by one procedure, as disclosed in U.S. Pat. No. 2,875,048; British Pat. No. 954,453; and German Patent Application OLS No. 1,163,142. A second method attempts to replace wet procedures in conventional silver halide photography with dry procedures, as disclosed in German Patent Application OLS No. 1,174,159; British Pat. Nos. 943,476 and 951,644; and so on. A third method uses as a main light-sensitive component a silver salt of a long chain aliphatic carboxylic acid such as silver behenate, silver saccharin, silver benzotriazole, etc., and a catalytic amount of a silver halide simultaneously, as disclosed in U.S. Pat. Nos. 3,152,904, 3,457,075, 3,635,719, 3,645,739, and 3,756,829 and Canadian Pat. No. 811,677; and so on.

The present invention belongs to the third method of the above-described three methods.

However, the unexposed parts of the heat-developed light-sensitive materials which have so far been proposed, for example, the unexposed parts of the compositions containing the silver salts of fatty acids such as silver behenate, etc., reducing agents and catalytic amounts of silver halides, become to a considerable extent black when heated (this phenomena is called "thermal fog" hereinafter), which makes the distinction between the images and the background difficult because there is very little contrast between the black images formed on the exposed parts by heating (image density) and the thermally fogged black background. Therefore, a reduction of thermal fog has been an important subject in this art. Moreover, storage of light-sensitive materials for a long time before use under conditions of high temperature (30° C.–50° C.) and high humidity (more than 50% relative humidity) causes fog resulting in the formation of indistinguishable images.

Mercury compounds are known to be effective for improving these disadvantages (as disclosed in U.S. Pat. No. 3,589,903). However, mercury compounds are well known to be toxic and to cause pollution difficulties. For example, heat development of mercury-containing light-sensitive materials results in the diffusion of mercury vapor into the air, and mercury is leached out when such light-sensitive paper are reclaimed as paper.

SUMMARY OF THE INVENTION

Therefore, an object of the present invention is to provide a heat developable light-sensitive material which has reduced thermal fog.

Another object of the present invention is to provide a heat developable light-sensitive material having less toxicity.

These and other objects of the present invention will become apparent from the following detailed descriptions.

The above-described objects can be successfully attained by employing a heat developable light-sensitive material comprising a support having thereon at least one layer and containing at least (a) an organic silver salt, (b) a light-sensitive silver halide or a component capable of forming a light-sensitive silver halide and (c) a reducing agent, and further containing (d) an iron family compound in at least one layer spread over the support.

DETAILED DESCRIPTION OF THE INVENTION

The organic silver salts of component (a) are moderately light stable white or pale yellow silver salts, and form silver images by reacting with reducing agents in the presence of exposed silver halide when heated at higher than about 80° C., preferably at higher than 100° C. Such organic silver salts include silver salts of imino group-, mercapto group-, hydroxy group- or carboxy group-containing organic compounds.

Specific examples of the above-described organic silver salts are illustrated below:

(1) Imino group-containing organic silver salts;

Silver benzotriazole, silver nitrobenzotriazole, silver alkylbenzotriazoles (e.g., silver methylbenzotriazole), silver halogen-substituted benzotriazoles (e.g., silver bromobenzotriazole), silver aminobenzotriazoles, silver carboimidosubstituted benzotriazoles, for example,

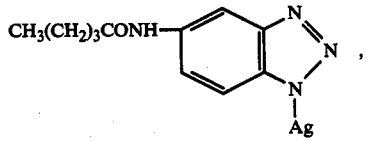

-continued

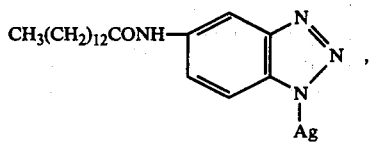

silver saccharin, silver phthalazinone, silver substituted phthalazinones, silver carbazole, silver benzimidazole, and the like (2) Mercapto group-containing organic silver salts;

Silver salt of 3-mercapto-4-phenyl-1,2,4-triazole, silver salt of 2-mercapto-benzimidazole, silver salt of 2-mercapto-5-aminothiadiazole, silver salt of 1-phenyl-5-mercaptotetrazole, silver salt of 2-mercaptobenzothiazole, silver salt of 2-(s-ethylthioglycolamido)benzothiazole, and the like, (3) Hydroxy group-containing organic silver salts;

Silver 4-hydroxy-6-methyl-1,3,3a,7-tetrazaindene and the like, (4) Carboxyl group-containing organic silver salts;

Silver salts of monocarboxylic higher fatty acids (e.g., silver caprate, silver laurate, silver myristate, silver palmitate, silver stearate, silver behenate, etc.), silver aliphatic dicarboxylates such as silver adipate, silver sebacate, silver maleate, silver fumarate, silver tartarate, silver linolate, silver salts of aromatic carboxylic acids such as silver benzoate, silver 3,5-dihydroxybenzoate, silver o-methylbenzoate, silver m-methylbenzoate, silver p-methylbenzoate, silver 2,4-dichloro benzoate, silver gallate, silver tannate, silver phthalate, silver terephthalate, silver salicylate, and the like.

A commonly used preparation method of the above-described organic silver salts comprises mixing a solution of a silver salt-forming organic compound dissolved in an appropriate solvent with an aqueous solution of a silver salt such as silver nitrate, silver complexes, etc. For example, the preparation of silver benzotriazole can be carried out as follows:

(a) a methanol solution of benzotriazole is mixed with an aqueous solution of silver nitrate to allow the benzotriazole to react with the silver nitrate, or (b) as disclosed in Japanese Patent Publication No. 30270/69, silver nitrate dissolved in a solvent A, capable of dissolving both silver nitrate and nitric acid, but hardly dissolving silver benzotriazole, is mixed with benzotriazole dissolved in a solvent B in which benzotriazole is soluble but both silver benzotriazole and silver nitrate are insoluble or substantially insoluble where the solubility of solvent A in solvent B is within about 1 to 30 wt% when defined as (weight of solvent A/weight sum of solvent A and solvent B) $\times$ 100. Suitable examples of solvent A include water, dimethylformamide, dimethylsulfoxide and the like, and suitable examples of solvent B include tricresyl phosphate, dimethoxyethyl phthalate, di-n-butyl phthalate, diethyl sebacate, monooctyl dibutyl phosphate, tributyl phosphate, castor oil, linseed oil, phosphoric, phthalic or dibasic fatty acid esters of phenols, and glycerin esters of higher fatty acids. In many cases a process similar to the above can be employed for other organic silver salts.

Another preparation method which is well suited for silver salts of organic carboxylic acids such as silver laurate, silver caprate, silver myristate, silver palmitate, silver stearate, silver behenate, silver adipate, silver sebacate, etc., comprises mixing an aqueous solution of a water soluble salt of a carboxylic acid (e.g., alkali metal salts such as sodium salt, potassium salt, lithium salt, etc., and an ammonium salt) with an aqueous solution of silver nitrate.

Silver salts of organic carboxylic acids can also be prepared by mixing a solution of an organic carboxylic acid in an appropriate solvent which dissolves an organic carboxylic acid quite well, hardly dissolves both the silver salt of the organic carboxylic acid and silver nitrate, and is sparingly insoluble in water (e.g., phosphric acid esters such as tricresyl phosphate, tributyl phosphate, mono-octyl dibutyl phosphate, etc.; phthalic acid esters such as diethyl phthalate, dibutyl phthalate, dimethyl phthalate, dioctyl phthalate, dimethoxyethyl phthalate, etc.; carboxylic acid esters such as amyl acetate, isopropyl acetate, isoamyl acetate, ethyl acetate, 2-ethylbutyl acetate, butyl acetate, propyl acetate, dioctyl sebacate, dibutyl sebacate, diethyl sebacate, diethyl succinate, ethyl formate, propyl formate, butyl formate, amyl formate, ethyl valerate, diethyl tartarate, methyl butyrate, ethyl butyrate, butyl butyrate, isoamyl butyrate, etc., glycerin esters of higher fatty acids such as castor oil; aromatic hydrocarbons such as benzene, toluene, xylene, etc.; n-hexane; cyclohexane; and so on), if necessary an emulsified solution of the above-described organic carboxylic acid solution with water or an alkaline aqueous solution (e.g., an aqueous solution of sodium hydroxide, an aqueous solution of potassium hydroxide or an aqueous solution of ammonia), with an aqueous solution of silver nitrate or an aqueous solution of a silver complex (preferably, an alkali soluble silver complex having a higher dissociation constant than that of the silver salt of an organic calboxylic acid; for example, silver ammine complex, silver methylamine complex, silver ethylamine complex, and the like), and they can also be prepared by mixing an emulsified solution of an aqueous solution of the salt of an organic carboxylic acid (e.g., the sodium salt, potassium salt, ammonium salt and the like) and the above-described solvent slightly soluble in water with an aqueous solution of silver nitrate or a silver complex. These methods can also be applied to the preparation of other organic silver salts. These preparation methods are described in detail in, for example, U.S. Pat. No. 3,458,544; Japanese Patent Publication No. 30270/69; Japanese Patent Application OPI No. 13224/74, German Patent Application OLS Nos. 2,322,096, 2,401,159 and 2,402,906; French Pat. No. 2,147,286; and so on.

Some silver salts of organic carboxylic acids which can be obtained using the method as disclosed in German Patent Applications OLS No. 2,402,906 are especially advantageous from the practical viewpoint of less thermal fog.

More specifically, heat-developable light-sensitive materials containing iron family compounds therein using organic silver salts which are formed in the presence of component (d) consisting of iron family compounds are advantageous. Namely, a mixture or a dispersion of the iron family compound and a solution of a silver salt-forming organic compound can be mixed with an aqueous solution of a silver salt such as silver nitrate or a silver complex such as silver ammonium complex. The three types of solutions, i.e., a solution or a dispersion of an iron family compound, an aqueous solution of a silver salt or a silver complex, and a solution or a dispersion of a silver salt-forming organic compound, can also be employed.

The simultaneous addition of a solution or a dispersion of an iron family compound and an aqueous solution of a silver salt or a silver complex into a solution or a dispersion of a silver salt-forming organic compound is advantageous. In this case, an aqueous solution of a silver salt or a complex can be begun to be added after beginning the addition of a solution or a dispersion of an iron family compound. Alternatively, the addition of an aqueous solution of a silver salt or complex can precede the addition of a solution or a dispersion of an iron family compound. The simultaneous start of the addition of the above two components, of course, can be employed. The conclusion of the addition of an iron family compound can be ahead of that of a silver salt or complex, or vise versa. Both can also be simultaneously completed. In addition, the mixing of a solution or a dispersion of a silver salt-forming organic compound with a mixture or a dispersion of a silver salt or complex and an iron family compound is also preferred.

The iron family compounds which can be employed in the present invention include iron compounds, cobalt compounds and nickel compounds, preferably cobalt compounds. Specific examples of these compounds are iron (II) nitrate, iron (III) nitrate, iron (II) acetate, iron (III) acetate, iron (II) formate, iron (III) formate, iron (II) sulfate, iron (III) sulfate, iron (II) perchlorate, iron (III) perchlorate, cobalt (II) nitrate, cobalt (III) nitrate, cobalt (II) acetate, cobalt (III) acetate, cobalt (II) formate, cobalt (III) formate, cobalt (II) sulfate, cobalt (III) sulfate, cobalt (II) perchlorate, cobalt (III) perchlorate, nickel (II) nitrate, nickel (II) acetate, nickel (II) formate, nickel (II) perchlorate and other water soluble iron group compounds. Iron family compounds having a solubility of more than about 0.01 g/100 ml of water (at 25° C.) are particularly useful. Of these compounds, cobalt nitrate, nickel nitrate and iron nitrate are greatly preferred. Moreover, iron group metal complexes are also suitable as the above-mentioned iron family compounds. Such complexes are coordination compounds comprising a central metal atom which belongs to the iron family and ligands, the coordinating atoms of which include at least one atom selected from the group consisting of atoms of Groups Va, VIa and VIIa and preferably halogen, nitrogen, oxygen, phosphorus, arsenic and sulfur atoms, or preferably a combination thereof.

Preferred central metal atoms belonging to the iron family metals include iron, cobalt and nickel, and inner complexes wherein the minus charge resulting from electro-negative ligands and the plus charge of the central metal atom compensate for each other and the coordinating sphere thereof become electrically neutral are preferred. Ligands comprising such inner complexes include $\beta$-diketones, oximes, oxines, dithiocarbamines, salicylic acid and picolinic acid.

Specific examples of the iron family coordination compounds are as follows:

| Number | Cordination Compound |
|---|---|
| Fe (III) COORDINATION COMPOUNDS: | |
| 1 | $[Fe(dtc)_3]$ |
| 2 | $[Fe(dtp)_3]$ |
| 3 | $[Fe(acac)_3]$ |
| 4 | $[Fe(oxin)_3]$ |
| 5 | $[FeN(CH_2CH_2O)_3]$ |
| 6 | $[Fe(bipy)_3](ClO_4)_3 \cdot 3H_2O$ |
| 7 | $[Fe(o\text{-}phen)_3](ClO_4)_3$ |
| 8 | $[Fe(urea)_6](ClO_4)_3$ |
| 9 | $(NH_4)_3[Fe(ox)_3]$ |
| 10 | $[Fe(py)_4](ClO_4)_3$ |

-continued

| Number | Cordination Compound |
|---|---|
| 11 | $Na[Fe(edta)] \cdot 3H_2O$ |
| 12 | $K_3[Fe(sal)_3]$ |
| 13 | $[Fe(NH_3)_6](ClO_4)_3$ |
| Fe (II) COORDINATION COMPOUNDS | |
| 14 | $[Fe(oxin)_2]$ |
| 15 | $[Fe(dmg)_2Py_2]$ |
| 16 | $[Fe(C_6H_5NH_2)_2Cl_2]$ |
| 17 | $[Fe(bipy)_3]SO_4$ |
| Co (III) COORDINATION COMPOUNDS: | |
| 18 | $[Co(NH_3)_6](NO_3)_3$ |
| 19 | $[Co(en)_3](NO_3)_3$ |
| 20 | $[Co(py)_6](NO_3)_3$ |
| 21 | $[Co(bipy)_3](NO_3)_3$ |
| 22 | $[Co(o\text{-}phen)_3](NO_3)_3$ |
| 23 | $K_3[Co(CN)_6]$ |
| 24 | $[Co(acac)_3]$ |
| 25 | $[Co(gly)_3]$ |
| 26 | $[Co(exan)_3]$ |
| 27 | $[Co(dtc)_3]$ |
| 28 | $[Co(oxin)_3]$ |
| 29 | 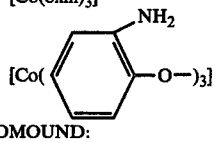 |
| Co (II) COORDINATION COMOUND: | |
| 30 | $[Co(acac)_2]$ |
| NI (II) COORDINATION COMPOUNDS: | |
| 31 | $[Ni(NH_3)_6](ClO_4)_2$ |
| 32 | $[Ni(en)_3](ClO_4)_2$ |
| 33 | $[Ni(py)_6](ClO_4)_2$ |
| 34 | $[Ni(py)_4Cl_2]$ |
| 35 | $[Ni(bipy)_3](NO_3)_2$ |
| 36 | $[Ni(o\text{-}phen)_2](NO_3)_2$ |
| 37 | $[Ni(oxin)_2] \cdot 2H_2O$ |
| 38 | $Ni(acac)_2$ |
| 39 | $Ni(3\text{-}Br\text{-}acac)_2$ |
| 40 | $Ni(H_2edta)/$ |
| 41 | $Ni(gly)_2$ |
| 42 | $Ni(NH_2OH)_4(NO_3)_2$ |

The abbreviations used herein and the structural formulae corresponding there are as follows:

| No. | Ligand | Abbreviation | Structural Formula |
|---|---|---|---|
| 1 | Diethyldithiocarbaminic acid ion | $dtc^-$ | $(C_2H_5)_2NCS_2^-$ |
| 2 | Diethyldithiophosphoric acid ion | $dtp^-$ | $(C_2H_5O)_2PS_2^-$ |
| 3 | 8-Oxyquinoline ion | $oxin^-$ | 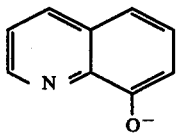 |
| 4 | Axetylacetone ion | $acac^-$ | 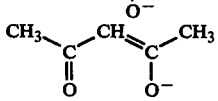 |
| 5 | Bipyridine | bipy | 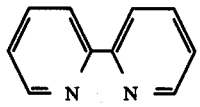 |
| 6 | o-Phenanthrene | o-phen | 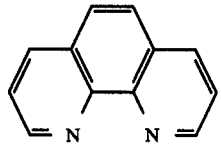 |
| 7 | Urea | urea | $NH-\underset{\underset{O}{\parallel}}{C}-NH_2$ |
| 8 | Oxalic acid ion | $ox^{2-}$ | $(O_2CCO_2)^{2-}$ |

-continued

| No. | Ligand | Abbreviation | Structural Formula |
|---|---|---|---|
| 9 | Pyridine | py | 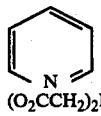 |
| 10 | Ethylenediamine tetra-acetic acid ion | $edta^{4-}$ | $(O_2CCH_2)_2NCH_2CH_2N(CH_2CO_2)_2^{4-}$ |
| 11 | Salicylic acid ion | $sal^{2-}$ | 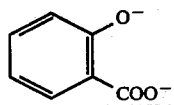 |
| 12 | Dimethylglyoxime anion | $dmg^-$ | $HONC(CH_3)C(CH_3)NO^-$ |
| 13 | Ethylenediamine | en | $NH_2CH_2CH_2NH_2$ |
| 14 | Glycine-anion | $gly^-$ | $NH_2CH_2COO^-$ |
| 15 | Ethylxanthate ion | $exan^-$ | $C_2H_5OCS_2^-$ |

The iron family compound (d) is effective in most cases when the concentration ranges from about $10^{-5}$ mole to $10^{-1}$ mole per mole of the organic silver salt (a), preferably from $10^{-4}$ to $10^{-2}$ mole per mole of the organic silver salt (a). Too small an amount of the iron family compound has too weak an action in preventing thermal fog, while an excess amount of the iron family compound colors the light-sensitive materials, and thus, it decreases the sensitivity.

Light-sensitive silver halides of component (b) which can be employed in the present invention include silver chloride, silver bromide, silver bromoiodide, silver chlorobromoiodide, silver chlorobromide, silver iodide and mixtures thereof.

These light-sensitive silver halides can be composed of either coarse or finely divided particles, but extremely fine particles of silver halide are particularly useful.

The iron family compounds which are employed in the present invention can be incorporated into light-sensitive materials before the step of silver halide-formation. They can also be effectively added to light-sensitive materials when the silver halide is prepared. Further, they can be added after the formation of the silver halide.

When the above-described three cases are compared, the addition of the iron family compound before or during silver halide-formation provides much more advantageous results than after the silver halide-formation.

As the iron family compounds which are added to light-sensitive materials during or before the silver halide formation, similar compounds to those mentioned above can be used. In these cases, iron family compounds soluble in organic solvents such as acetone, alcohols (e.g., methanol, ethanol, propanol, isopropanol, etc.), 2-methoxyethanol, toluene and the like, more specifically having a solubility of more than about 0.01 g per 100 ml of the organic solvent (at 25° C.) are also preferred for use.

The addition of the halides of iron family metals as the iron family compounds provides less preferable results in the practice of the present invention.

The iron family compound which is soluble in an organic solvent will be effective just as in the above case when used in a concentration ranging from about $10^{-5}$ to $10^{-1}$ mole per mole of the organic silver salt (a), preferably from $10^{-4}$ to $10^{-2}$ mole.

The silver halides which are effectively incorporated into heat-developable light-sensitive materials of the present invention can be formed by a method wherein the organic silver salt component (a) is prepared in presence of a light-sensitive silver halide-forming component (described hereinafter). This method is described in, for example, German Patent Application OLS No. 2,428,125. When the iron family compound of component (d) is present with both the organic silver salt component (a) and the silver halide-forming component (b) in the above-described method, heat developable light-sensitive materials which have reduced thermal fog, a characteristic feature of this invention, can be obtained.

Specific examples of silver halide-forming methods which can be employed in the present invention are as follows: light-sensitive silver halide-forming components (described hereinafter) are already present when the organic silver salt (a) is prepared with the light-sensitive silver halide-forming component being incorporated into a solution of the above-described organic silver salt in the form of a solution when soluble, or in the form of a dispersion or an emulsion when insoluble; or with a solution, a dispersion or an emulsion of the light-sensitive silver halide-forming component being added to the mixture of a solution of the organic carboxylic acid or the salt thereof and a solution of a silver salt such as silver nitrate or a silver complex just when the latter two components are being mixed. In such processes, the objects of the present invention can be attained with the iron family compounds described above being incorporated into one of the above-described solutions, dispersions, or emulsions; or the solution, the dispersion or the emulsion of the iron family compound prepared separately being added to one of the above-described solutions, dispersions or emulsions. The iron family compounds are preferably added to the reaction system before the addition of the silver halide-forming components, but they can be added together with the silver halide-forming components or after the addition thereof although the efficiency is somewhat reduced. The time of addition of the iron family compounds in the above processes which is effective can be similarly employed in other methods described below.

Another method of forming a catalytic amount of light-sensitive silver halide comprises mixing a pre-prepared silver halide with an organic silver salt. This method is described in, for example, U.S. Pat. Nos. 3,152,904, 3,706,564, 3,706,565, and 3,713,833; Japanese Patent Application ODI Nos. 32928/75 and 32926/75 Belgian Pat. No. 774,436 and French Pat. No. 2,078,586. In such a method, the objects of the present invention can be attained with the iron family compound being used together with the silver halide-forming component, or with the iron family compound being present on mixing the organic silver salt, and further with the iron family compound being added to the mixture of the organic silver salt and silver halide although this is less effective than the above two procedures.

A most preferred method for forming the light-sensitive silver halide comprises converting only a part of the organic silver salt into a catalytic amount of silver halide by allowing a pre-prepared organic silver salt to react with the light-sensitive silver halide-forming component (described below). This method is disclosed in, for example, U.S. Pat. No. 3,457,075 and Japanese Pat. Application OPI No. 78316/75.

In the above method, the iron family compounds can be preferably added to a dispersion of an organic silver salt before or during the silver halide-forming process.

Organic silver salts which are prepared in the presence of the above-described iron family compounds are most suitable for use.

All compounds which can form silver halides by reacting with organic silver salts can be employed as silver halide-forming components. Which silver halide-forming components are more effective in this respect can be easily determined. That is to say, this can be determined by examining the diffraction peak characteristics for silver halides using X-ray diffraction techniques after the silver halide-forming components are allowed to act on the organic silver salts and, if desired, heating the reactants.

Most preferred compounds as silver halide-forming components are those which can liberate halogen atoms or ions, and the liberation of these can be accelerated by heating.

Specific examples of silver halide-forming components include inorganic halides represented by the general formula $$MX_n$$

wherein M represents H, $NH_4$ or a metal atom such as rhodium, lithium, sodium, potassium, rubidium, cesium, copper, gold, beryllium, magnesium, calcium, strontium, barium, zinc, cadmium, mercury, aluminium, gallium, indium, thallium, germanium, tin, lead, antimony, bismuth, chromium, molybdenum, tungsten, manganese, rhenium, iron, nickel, ruthenium, palladium, osmium, iridium and platinum, X represents Cl, Br or I, and n represents 1 when M represents H or $NH_4$, and n equals the valence of the metal when M represents the above metals. Other specific examples of silver halide-forming components are halogen-containing metallic complexes such as $K_2PtCl_6$, $K_2PtBr_6$, $HAuCl_4$, $(NH_4)_2IrCl_6$, $(NH_4)_3IrCl_6$, $(NH_4)_2RuCl_6$, $(NH_4)_3RuCl_6$, $(NH_4)_3RhCl_6$, $(NH_4)_3RhBr_6$ and the like.

Still other specific examples of silver halide-forming components are onium halides such as cetylethyldimethylammonium bromide, trimethylbenzylammonium bromide and the like.

Other specific examples of silver halide-forming components are halogenated hydrocarbons such as iodoform, bromoform, carbon tetrabromide, 2-bromo-2-methylpropane, etc. Halogen-containing compounds such as triphenyl methyl chloride, triphenyl methyl bromide, 2-bromobutyric acid, 2-bromoethanol, dichlorobenzophenone and the like are also employed as silver halide-forming components.

N-halo compounds are most suitable for silver halide-forming components because they can also reduce thermal fog.

Typical examples of N-halo compounds which are suitable for the purposes of the present invention include the compounds represented by the following general formulae (I) and (II):

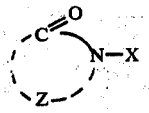

(I)

-continued

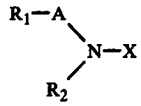

(II)

wherein X represents a halogen atom such as chlorine, bromine and iodine; Z represents an atomic group required for the formation of a 5- or 6-membered ring, which may condense with another ring; A represents a carbonyl group or a sulfonyl group; and $R_1$ and $R_2$ each represents an alkyl group, an aryl group or an alkoxy group, wherein alkyl groups or alkoxy groups containing 1 to 12 carbon atoms are advantageous with those containing 1 to 8 carbon atoms being more preferable, and with unsubstituted or substituted phenyl and naphthyl groups being preferred as aryl groups.

Specific examples of the above 5- or 6-membered ring formed by Z include a pyrrole ring, a pyrroline ring, a pyrrolidine ring, an imidazoline ring, an imidazolidine ring, a pyrazoline ring, a pyrazolidine ring, a piperidine ring, an oxazine ring, a thiazine ring, a piperazine ring, a hydantoin ring, a cyanuric acid ring, a thiohydantoin ring, an indoline ring, and the like.

Moreover, the above rings can be substituted with alkyl groups, aryl groups, alkoxy groups, halogen atoms, oxygen (=O), sulfur (=S) and so on.

Examples of alkyl groups which can be substituents on the above-described rings include alkyl groups having 1 to 12 carbon atoms, e.g., methyl, ethyl, propyl, isopropyl, butyl, isobutyl, t-butyl, pentyl, hexyl, 2-ethylhexyl, octyl, nonyl, decyl, dodecyl and the like, with alkyl groups having 1 to 8 carbon atoms being more preferred. Preferred aryl groups which can be substituents on the above-described rings include unsubstituted or substituted phenyl and naphthyl groups, with preferred substituents being alkyl groups containing 1 to 4 carbon atoms such as methyl, ethyl, propyl, isopropyl, butyl and t-butyl groups, and halogen atoms such as chlorine, bromine and iodine. Examples of alkoxy groups which can be substituents on the above-described rings are alkoxy groups having 1 to 12 carbon atoms, preferably 1 to 8 carbon atoms, such as methoxy, ethoxy, propoxy, isopropoxy, butoxy, t-butoxy, pentoxy, hexoxy, octoxy and dodecyloxy groups.

In addition, melamine halides are suitable silver-halide forming compounds which can be used in the present invention.

Specific examples of N-halo compounds which are preferred for use in the present invention are as follows.

(1) N-Bromosuccinimide
(2) N-Bromotetrafluorosuccinimide
(3) N-Bromophthalimide
(4) N-Bromoglutarimide
(5) 1-Bromo-3,5,5-trimethyl-2,4-imidazolidinedione
(6) 1,3-Dibromo-5,5-dimethyl-2,4-imidazolidinedione
(7) N,N'-Dibromo-5,5-diethylbarbituric acid
(8) N,N'-Dibromobarbituric acid
(9) N-Bromoisocyanuric acid
(10) N-bromoacetamide
(11) N-Bromochloroacetamide
(12) N-Bromotrifluoroacetamide
(13) N-Bromoacetanilide
(14) N-bromobenzenesulfonylanilide
(15) N-Bromobenzamide
(16) N-Bromobenzenesulfonylamide

(17) N-Bromo-N-benzenesulfonylbenzenesulfonylamide
(18) N-Bromophthalazone
(19) N-Chlorosuccinimide
(20) N-Iodosuccinimide
(21) Trichloroisocyanuric acid
(22) N-Chlorophthalimide
(23) 1,3-Dichloro-5,5-dimethyl-2,4-imidazolidinedione
(24) 3-Chloro-5,5-dimethyl-2,4-imidazolidinedione
(25) 1,3-Dichloro-5,5-dimethyl-2,4-imidazolidinedione
(26) Trichloromelamine
(27) Tribromomelamine
(28) N-Bromocyclohexanedicarbonimide
(29) 1-Bromo-3,5,5-triethyl-2,4-imidazolidinedione
(30) 1-Bromo-3-ethyl-5,5-dimethyl-2,4-imidazolidinedione
(31) 1,3-Dibromo-5,5-diethyl-2,4-imidazolidinedione
(32) N,N-Dibromo-5,5-dimethylbarbituric acid
(33) N,N-Dibromo-5-ethyl-5-methylbarbituric acid
(34) N,N-Dibromo-5-ethyl-5-phenylbarbituric acid
(35) N,N'-Dibromoisocyanuric acid
(36) N-Bromoacetamide
(37) N-Bromonaphthamide
(38) N-Bromohydroxybenzamide
(39) N-Bromocarboxybenzamide
(40) N-Bromotoluenesulfonamide
(41) N-Bromo-N-toluenesulfonyltoluenesulfonylamide
(42) 1-Bromo-3,5,5-trimethyl-2,4-imidazolidinedithione
(43) 1-Bromo-3,5,5-triethyl-2,4-imidazolidinedithione
(44) 1-Bromo-3-ethyl-5,5-dimethyl-2,4-imidazolidinedithione
(45) 1,3-Dibromo-5,5-dimethyl-2,4-imidazolidinedithione
(46) 1,3-Dibromo-5,5-diethyl-2,4-imidazolidinedithione
(47) 1,3-Dichloro-5,5-dimethyl-2,4-imidazolidinedithione
(48) 3-Chloro-5,5-dimethyl-2,4-imidazolidinedithione
(49) 1,3-Diiodo-5,5-dimethyl-2,4-imidazolidinedithione
(50) N-Bromosaccharin The N-halo compounds can be mixed with the organic silver salts in any form.

Other N-halo compounds such as benzotriazole, substituted benzotriazoles which may be substituted with an alkyl, nitro, imido or amino group or a halogen atom, and the like are effectively used herein.

In both the previous and the present methods, the ripening of the reaction system after the addition of silver halide-forming components by allowing the system to stand for an appropriate time (e.g., about 20 minutes to 48 hours) at room temperature (e.g., about 20 to 30° C.) or at high temperature (30° C. to 80° C.) is effective for improving the quality of light-sensitive materials. For example, this results in increased sensitivity.

The above-described silver halide-forming components can be used individually or in combination. The silver halide-forming component is effective when it is used in amounts ranging from about 0.001 mole to about 0.5 mole, more preferably 0.01 mole to 0.2 mole, per mole of the organic silver salt component (a). A too small amount of the silver halide-forming component reduces sensitivity, while an excess amount thereof increases the color change by light to result in a reduced contrast between the image area and the background. The color change by light indicates the phenomenon wherein when the finished light-sensitive materials after heat development are allowed to stand exposed to room light, the color of the non-image area (background) progressively darkens.

The reducing agents of component (c) which can be employed in the present invention reduce the organic silver salts (component (a)) to produce silver images when heated in the presence of the exposed silver halide (component (b)) which acts as a catalyst.

The suitability of the reducing agent depends upon the organic silver salt which is used in combination therewith, and appropriate reducing agents generally include substituted phenols, substituted or unsubstituted bisphenols, substituted or unsubstituted mono- or bis-naphthols, di- or polyhydroxy benzenes, di- or polyhydroxynaphthalenes, hydroquinone monoethers, ascorbic acid or derivatives thereof, 3-pyrazolidones, pyrazoline-5-ones, reducing saccharides, p-phenylenediamine or the derivatives thereof, aminoreductones, kojic acid, hinokitiol and the like.

Specific examples of the above described reducing agents are disclosed in, for example, U.S. Pat. Nos. 3,152,904, 3,457,075, 3,531,286, 3,679,426, 3,672,904, 3,773,512, 3,751,249, and 3,667,958; Canadian Pat. No. 811,677, Japanese Patent Publication Nos. 1111/72 and 41865/71; Japanese Patent Application OPI Nos. 115540/74 and 36110/75; Belgian Pat. No. 786,086; and German Patent Application OLS No. 2,031,748.

Specific examples of suitable reducing agents include:

(1) Substituted phenols;

p-Aminophenol, o-aminophenol, N-methyl-aminophenol, 2-methoxy-4-aminophenol, 2,4-diaminophenol, 2-β-hydroxyethyl-4-aminophenol, p-t-butylphenol, p-t-amylphenol, p-cresol, p-acetophenol, 2,6-di-t-butyl-p-cresol, p-phenylphenol, p-ethylphenol, p-sec-butylphenol, o-phenylphenol, 1,4-dimethoxyphenol, p-acetoacetyl-4-methylphenol, 2,3-dimethylphenol, 3,4-xylenol, 2,4-xylenol, 2,6-dimethoxy-2,4,5-trimethylphenol, 2,4-di-t-butyl-phenol, phenol, 3,5-di-t-butylhydroxy benzyldimethylamine, chlorothymol, α-phenyl-o-cresol, p-nonylphenol, p-octylphenol, etc.

(2) Substituted or unsubstituted bisphenols;

Bisphenol A 1,1-bis(2-hydroxy-3,5-dimethylphenyl)-3,5,5-trimethylhexane, 2,4,4-trimethylpentyl-bis(2-hydroxy-3,5-dimethylphenyl)methane, bis(2-hydroxy-3-t-butyl-5-methylphenyl)methane, bis(2-hydroxy-3,5-di-t-butylphenyl)methane, 4,4'-methylene-bis(3-methyl-5-t-butylphenol), 4,4'-methylene-bis(2,6-di-t-butylphenol), 2,2'-methylene-bis(2-t-butyl-4-ethylphenol), 2,6-methylene-bis(2-hydroxy-3-t-butyl-5-methylphenyl)-4-methylphenol, 3,3',5,5'-tetra-t-butyl-4,4'-dihydroxybiphenyl, 1,1-bis(4-hydroxyphenyl)cyclohexane, 1,1-bis(5-chloro-2-hydroxyphenyl)methane, 2,2-bis(3,5-dibromo-4-hydroxyphenyl)propane, 2,2-bis(4-hydroxyphenyl)propane, 2,2-bis(3,5-dimethyl-4-hydroxyphenyl)propane, 2,2-bis(3-methyl-4-hydroxyphenyl)propane, bis(3-methyl-4-hydroxy-5-t-butylphenyl)sulfide, α,α'-(3,5-di-t-butyl-4-hydroxyphenyl)-diethylether, N,N'-di(4-hydroxyphenyl)urea, diethylstilbestrol, hexestrol, etc.

(3) Substituted or unsubstituted bisnaphthols and di- or poly-hydroxynaphthalenes;

Sodium 1-amino-2-naphthol-6-sulfonate, 1-naphthylamine-7-sulfonic acid, 1-hydroxy-4-methoxynaphthalene, 1,4-dihydroxynaphthalene, 1,3-dihydroxynaphthalene, 1,3-dihydroxynaphthalene, 1-hydroxy-4-aminonaphthalene, 1,5-dihydroxynaphthalene, 1-hydroxy-2-phenyl-4-methoxynaphthalene, 1-hydroxy-2-methyl-4-methoxynaphthalene, α-naphthol, β-naphthol, 1,1'-dihydroxy-2,2'-binaphthyl, 4,4'-dimethoxy- 1,1'-dihydroxy-2,2'-binaphthyl, 6,6'-dichloro-2,2'-dihydroxy-1,1'-binaphthyl, 6,6'-dinitro-2,2'-dihydroxy-1,1'-binaphthyl, bis(2-hydroxy-1-naphthyl)methane, etc.

(4) Di- or poly-hydroxybenzenes and hydroquinone monoethers;

Hydroquinone, methylhydroquinone, chlorohydroquinone, bromohydroquinone, phenylhydroquinone, hydroquinone monosulfonate, t-octylhydroquinone, t-butylhydroquinone, 2,5-dimethylhydroquinone, 2,6-dimethylhydroquinone, methoxyhydroquinone, ethoxyhydroquinone, catechol, pyrogallol, resorcinol, 1-chloro-2,4-dihydroxybenzene, 3,5-di-t-butyl-2,6-dihydroxybenzoic acid, 2,4-dihydroxybenzoic acid, 2,4-dihydroxyphenyl sulfide, p-methoxyphenol, p-ethoxyphenol, hydroquinone monobenzyl ether, 2-t-butyl-4-methoxyphenol, hydroquinone mono-n-hexyl ether, methyl gallate, propyl gallate, etc.

(5) Ascorbic acid or the derivatives thereof, and other photolytic reducing agents;

l-Ascorbic acid, isoascorbic acid, ascorbic acid monoester (e.g., ascorbic acid monolaurate, monomyristate, monopalmitate, monostearate, and monobehenate), ascorbic acid diester (e.g., ascorbic acid dilaurate, dimyristate, dipalmitate, distearate, and the like), furoin, benzoin, dihydroxyacetone, glycerine aldehyde, tetrahydroxyquinone rhodizonate.

(6) 3-Pyrazolidones and pyrazolones;

1-Phenyl-3-pyrazolidone, 4-methyl-4-hydroxymethyl-1-phenyl-3-pyrazolidone, 1-(2-quinolyl)-3-methyl-5-pyrazolone.

(7) Reducing saccharides and others;

Glucose, lactose and the like, p-oxyphenylglycine, hydroxytetronic acid, N,N-di(2-ethoxyethyl)hydroxylamine, N,N-dialkyl-p-phenylenediamines, 5,7-dihydroxy-4-methylcoumarin, kojic acid, hinokitiol.

These reducing agents may be used individually or in combination. The selection of suitable reducing agents depends upon the organic silver salt (component (a)) with which it is used in combination.

For example, moderately strong reducing agents such as hydroquinone are preferred for silver salts of higher fatty acids such as silver behenate, etc., which are relatively difficult to be reduced. On the other hand, moderately weak reducing agents such as bisphenol A, etc. are preferred for silver salts relatively easy to be reduced such as silver caprate. That is to say, the reducing agent can be easily selected depending on the organic silver salt used.

The amount of the above-described reducing agents can vary widely since the amount is influenced by the organic silver salt, the reducing agent and other additives such as a color toning agent present the system and the amount can not be set forth unequivocally. However, the reducing agent is generally effective when it is used in an amount ranging from about 0.1 mole to about 5 mole, preferably from 0.2 mole to 2 mole, per mole of the organic silver salt (a).

Color toning agents which are one of the additives which can be employed in combination with the above-described reducing agents preferably are added when a black tone image is desired. The color toning agent is generally used in an amount ranging from about 0.0001 mole to 2 mole, preferably 0.0005 mole to 1 mole, per mole of the organic silver salt (a). Phthalazinone and the derivatives thereof are most commonly used as color toning agents. Other color toning agents which can be effectively used include phthalimide, oxazinediones, pyrazoline-5-ones, quinazolinone, mercapto compounds and so on. Examples of these color toning agents are disclosed in, for example, Japanese Patent Application OPI Nos. 5020/73 and 2524/75; Japanese Patent Application OPI No. 6077/71; German Patent Application OLS Nos. 2,140,406 and 2,141,063.

In the present invention, components (a), (b), (c) and (d), preferably dissolved or dispersed into an appropriate binder, are coated onto a support. On this occasion, components (a) and (b), and components (c) and (d) can be dissolved or dispersed into a binder, and can be coated on a support in one layer or as multi-layers, or components (a) and (b), and components (c) and (d) each can be dissolved or dispersed individually into binders, and then they each can be coated as individual layers. Combinations of components (a), (b) and (c), and component (d); and components (a), (b) and (d), and component (c) can also be employed herein.

Conventionally used binders in this art are suitable as binders used in the present invention Hydrophobic binders are preferred herein, but hydrophilic binders can also be employed. Such binders preferably are transparent or translucent. Examples of suitable binders which can be used in this invention include natural substances such as gelatin, gelatin derivatives, etc., mixtures of these natural substances with latex-like vinyl polymers, cellulose derivatives, synthetic polymers and so on.

Specific examples of suitable binders include gelatin, phthaloylated gelatin, polyvinyl butyral, polyacrylamide, cellulose acetate butyrate, cellulose acetate propionate, polymethylmethacrylate, polyvinyl pyrolidone, polystyrene, ethylcellulose, polyvinyl chloride, chlorinated rubbers, polyisobutylene, butadiene-styrene copolymers, vinyl chloride-vinyl acetate copolymers, vinyl acetate-vinyl chloride-maleic acid copolymers, polyvinyl alcohol, polyvinyl acetate, benzylcellulose, cellulose diacetate, cellulose triactate, cellulose propionate, cellulose acetate phthalate and the like. The binders can be used individually or in combination. The amount of the above binders can be used in a weight ratio ranging from about 10:1 to 1:10, preferably 4:1 to 1:4, to the organic silver salt (a).

Various kinds of supports can be employed in the present invention. Typical supports include a cellulose nitrate film, a cellulose ester film, a poly(vinylacetal) film, a polystyrene film, a poly(ethylene terephthalate) film, a polycarbonate film, glass, paper, metal and so on.

Art paper or a coated paper can be employed advantageously as a support paper. Water proof paper and synthetic resin-coated paper can also be employed as the supporting paper.

The coating amount of silver on the support can range from about 0.2 to 3 g, preferably 0.3 to 2 g, per $lm^2$ of support. A coating amount less than about 0.2 $g/m^2$ does not provide an image of sufficient density, while a coating amount greater than about 3 $g/m^2$ is rather expensive and no remarkable improvements in the photographic characteristics resulting from the excess addition are achieved.

The heat developable light-sensitive material of the present invention can also contain an antistatic layer or a conductive layer. In addition, anti-halation materials and anti-halation dyes can be incorporated in the heat developable light-sensitive material of this invention.

The heat developable light-sensitive materials of the present invention can optionally contain matting agents such as starch, titanium dioxide, zinc oxide, silica and kaolin. They can further contain fluorescent brightening agents such as stilbenes, triazines, oxazoles and coumarin fluorescent brightening agents.

The heat developable light-sensitive layers used in the present invention can be coated using various techniques such as a dipping method, an air knife method, a curtain coating method and a hopper-using an extrusion coating method as disclosed in U.S. Pat. No. 2,681,294. Two or more layers can be optionally coated simultaneously.

Some kinds of optical sensitizing dyes which are effective when incorporated in conventional silver halide emulsions can also provide additional sensitivty to heat developable light-sensitive materials of the present invention. For example, a solution or a dispersion of a sensitizing dye in an appropriate organic solvent can be added to the heat developable light-sensitive material of the present invention to increase the optical sensitivity. Examples of optical sensitizing agents which can be used herein include the cyanine dyes, moncyanine dyes, rhodacyanine dyes, styryl dyes, trinuclear merocyanine dyes, Erythrosine, Eosine, fluorescein and other acidic dyes. The preferred amount of these dyes employed ranges from about $10^{-4}$ mole to $10^{-2}$ mole per mole of organic silver salt component (a).

Preferred sensitizing dyes are disclosed in, for example, U.S. Pat. Nos. 3,457,075, 3,719,495 and 3,761,279; Belgian Pat. No. 788,695; Japanese Patent Application OPI Nos. 84637/74, 105524/74, 96717/74, 102328/74, 2924/75 and 29029/75; Japanese Patent Application OPI No. 4728/71; and so on.

In addition, the heat developable light-sensitive layer can contain additives, i.e., N-halo compounds, which can prevent thermal fog. Thermal fog-preventing additives are described in Japanese Patent Application OPI Nos. 10724/74, 97613/74, 90118/74 and 130720/74.

The heat developable light-sensitive layers of the present invention can contain acids such as terephthalic acid or the anhydride thereof, higher fatty acids, benzene sulfonic acid, p-toluene sulfonic acid and other sulfonic acids as a stabilizing agent. These stabilizing agents are described in Japanese Patent Application OPI Nos. 125016/74 and 57619/75, and so on. Sulfinic acids (benzene sulfinic acid or the salts thereof, p-toluene sulfinic acid or the salts thereof, and the like), benzotriazole and the derivatives thereof, and mercapto compounds such as 1-phenyl-5-mercaptotetrazole can also be employed in the heat developable light-sensitive layers as a stabilizing agent.

A top-coat of a polymer film can be optionally provided on the light-sensitive layer in order to increase the transparency of the heat developable light-sensitive layers, in order to increase the image density and in order to improve the photographic characteristics of the light-sensitive materials so that the properties the material possesses immediately after production are maintained on storage. The thickness of the top-coat of the polymer film preferably ranges from about 1$\mu$ to 20$\mu$. Examples of polymers which can be employed in the top-coat layer on a light-sensitive layer include polyvinyl chloride, polyvinyl acetate, vinyl chloride-vinyl acetate copolymers, polyvinyl butyral, polystyrene, polymethylmethacrylate, polyurethane rubber, xylene resins, benzylcellulose, methylcellulose, ethylcellulose, cellulose acetate butylate, cellulose diacetate, cellulose triacetate, polyvinylidene chloride, chlorinated polypropylene, polyvinyl pyrrolidone, cellulose propionate, polyvinyl formal, cellulose acetate phthalate, polycarbonate, cellulose acetate propionate, and so on. Incorporation of a material such as kaolin, silica (silicon dioxide), etc., in the top coat polymer film is preferred because the heat developable light-sensitive material can be written upon with a ball-point pen or a pencil after the forming of images.

Moreover, ultraviolet light-absorbing agents and higher fatty acids can be incorporated in the top coat polymer film.

In order to form color images, phenolic couplers or active methylene-containing color couplers can also be used in combination with p-phenylene diamines which function as a reducing agent, as disclosed in U.S. Pat. No. 3,531,286.

The above-described heat developable light-sensitive materials can be developed merely by heating the light-sensitive materials after exposure to a light source such as xenon lamp, a tungsten lamp, a mercury lamp, a fluorescent lamp for copying and the like. A suitable exposure time can range from about $10^{-9}$ sec to about $10^{3}$ sec, preferably $10^{-6}$ sec to $10^{2}$ sec.

An appropriate heating temperature for development is about 80° C. to 180° C., more preferably 110° C. to 150° C. Higher or lower temperatures than the above-mentioned temperature range can be employed by appropriately increasing or decreasing the heating time. A suitable development time is usually about 1 to 60 sec.

Various means for heat developing can be employed with the light-sensitive materials employed in the present invention, for example, the light-sensitive materials can be developed by contacting the materials with a simple heated plate or a heated drum. Alternatively, they can be developed by passing the material through a heated space. In still another case, they can be developed by heating with high frequency waves or a laser beam.

In accordance with the present invention, heat developable light-sensitive materials having markedly reduced thermal fog are provided, which are easy to handle because they are not toxic in contrast to the situation which exists when mercury is used. In addition, heat developed light-sensitive materials undergo only a slight discoloration when exposed for a time to normal room illumination. Moreover, images of high density can be obtained.

The present invention will now be illustrated in greater detail by reference to the following examples. Unless otherwise indicated, all parts, percents, ratios and the like are by weight.

EXAMPLE 1

1.9 g of sodium hydroxide was dissolved in 100 ml of water, to which 12 g of lauric acid in 100 ml of toluene was added and the mixture was emulsified (at 25° C.). Further, an aqueous solution of silver nitrate consisting of 8.5 g of silver nitrate and 50 ml of water was added to the above emulsion to result in a separation into a silver laurate-containing toluene phase and an aqueous phase. After removal of the aqueous phase, the toluene phase was dispersed in 200 ml of methanol, and silver laurate was collected by centrifuging. 12 g of spindle-like silver laurate crystals of about a length of about 3$\mu$ was obtained. A polymer dispersion of a silver salt was prepared by dispersing 6 g of the resulting silver laurate in 12 g of polyvinyl butyral and 70 ml of isopropyl alcohol using a mixer. The polymer dispersion of the silver salt was maintained at 50° C. with stirring, to which 0.02 g of cobalt nitrate was added, followed by stirring for 20 minutes. 0.15 g of N-bromosuccinimide (silver halide-forming component) was then added, and further the resultant mixture was stirred for 90 minutes. After chillsetting at a temperature of 30° C., a heat developable light-sensitive coating solution using the composition containing the components set forth, with the components being added in the order listed every 5 minutes to the dispersion with stirring, was prepared.

| COMPOSITION | |
|---|---|
| Dye* (0.015% 2-methoxyethanol solution) | 10 ml |
| Phthalazinone (color toning agent) (3% methanol solution) | 50 ml |
| 2,2-bis(3,5-Dimethyl-4-hydroxyphenyl)-propane (reducing agent) (20% acetone solution) | 30 ml |
| Stearic Acid (stabilizing agent) (3% 2-methoxyethanol solution) | 15 ml |

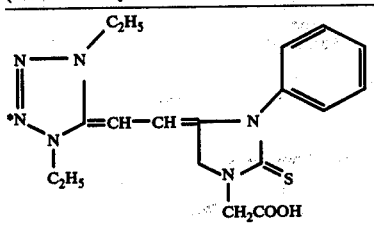

The resulting coating solution was then coated on art paper at a coverage of 0.4 g of silver per square meter, resulting in the preparation of heat developable Light-Sensitive Material (A).

For the purpose of comparison with the above Light-Sensitive Material (A), a heat-developable Light-Sensitive Material (B) was prepared in the same manner as heat-developable Light-Sensitive Material (A) except that cobalt nitrate was not added to the polymer dispersion of the silver salt. For the purpose of further comparison with the above Light-Sensitive Material (A), heat developable Light-Sensitive Material (C) was prepared the same manner as heat developable Light-Sensitive Material (A) except that 0.25 g of mercuric bromide was added instead of the addition of the cobalt nitrate and the N-bromosuccinimide.

A ten percent alcohol solution of ethyl cellulose containing 1.5 wt% of silicon dioxide was top-coated on the above three kinds of heat developable Light-Sensitive Materials (A), (B) and (C).

These three kinds of heat developable Light-Sensitive Materials (A), (B) and (C) were exposed through a wedge containing gradations, and then developed by heating under two different conditions; heating at a temperature of 120° C. for 40 seconds, and heating at a temperature of 140° C. for 15 seconds. Good black images were formed on the exposed parts in both cases, but large differences in the non-exposed parts were detected. The results obtained are set forth below.

| Heating Condition | | Light-Sensitive Material (A) | Light-Sensitive Material (B) | Light-Sensitive Material (C) |
|---|---|---|---|---|
| 120° C for 40 sec | | | | |
| | $D_{max}$ | 1.49 | 1.38 | 1.10 |
| | $D_{min}$ | 0.16 | 0.35 | 0.15 |
| 140° C for 15 sec | | | | |
| | $D_{max}$ | 1.35 | 1.28 | 1.02 |
| | $D_{min}$ | 0.18 | 0.39 | 0.16 |

It is apparent from the results in the above table that Light-Sensitive Material (A) had excellent thermal fog resistance properties. In addition, the most striking aspect of these results is that Light-Sensitive Material (A) had a rather increased image density without a reduction in photosensitivity. (Usually additives for inhibiting thermal fog, e.g., benzotriazole and the like, reduce remarkably both photosensitivity and image density even if they reduce thermal fog.)

EXAMPLE 2

Heat developable Light-Sensitive Material (D) was prepared the same manner as heat developable Light-Sensitive Material (A) above except that 0.04 g of cobalt acetate was used instead of cobalt nitrate, 0.3 g of N-bromophthalazinone was used instead of N-bromosuccinimide, and the polymer dispersion of the silver salt was maintained at a temperature of 30° C. instead of at a temperature of 50° C.

For the purpose of comparison with heat developable Light-Sensitive Material (D), heat developable Light-Sensitive Material (E) was prepared the same manner as heat developable Light-Sensitive Material (D) except that cobalt acetate was not added to the polymer dispersion of the silver salt. They were exposed and developed by heating under the same conditions as in Example 1. The following results were obtained.

| Heating Condition | | Light-Sensitive Material (D) | Light-Sensitive Material (E) |
|---|---|---|---|
| 120° C for 40 sec | | | |
| | $D_{max}$ | 1.52 | 1.45 |
| | $D_{min}$ | 0.18 | 0.30 |
| 140° C for 15 sec | | | |
| | $D_{max}$ | 1.46 | 1.38 |
| | $D_{min}$ | 0.18 | 0.32 |

It is evident that Light-Sensitive Material (D) was superior to Light-Sensitive Material (E).

After overnight storage at a temperature of 50° C. and 80% relative humdity, heat developable Light-Sensitive Materials (A) to (E) each was exposed and developed by heating under the same conditions as in Examples 1 and 2. The processed Light-Sensitive Materials (A), (C) and (D) were scarcely thermally-fogged, but the entire surface of the processed Light-Sensitive Materials (B) and (E) became black.

EXAMPLE 3

1.9 g of sodium hydroxide dissolved in 100 ml of water was mixed with a solution of 12 g of lauric acid in 100 ml of toluene to form an emulsion (at 25° C). Then, an aqueous solution of 8.5 g of silver nitrate in 50 ml of water and another aqueous solution of 0.02 g of cobalt nitrate in 50 ml of water were added simultaneously to the above emulsion over a 30 second period.

The resulting mixture separated into a silver laurate-containing toluene phase and a water phase. The toluene phase was withdrawn and the silver laurate was dispersed in 30 g of polyvinyl butyral and 200 ml of isopropyl alcohol using a mixer, resulting in the preparation of a polymer dispersion of a silver salt.

0.6 g of N-bromosuccinimide (silver halide-forming component) was added to the above dispersion, and the dispersion was stirred for 40 minutes at a temperature of 60° C. After chillsetting at a temperature of 30° C., a composition containing the components set forth below was added to 20 g of the polymer dispersion of the silver laurate in their listed order.

| COMPONENT | |
|---|---|
| $HgBr_2$ (heat-fog inhibitor) 1.5% methanol solution) | 2 ml |
| Dye* (0.025% 2-methoxyethanol solution) | 2 ml |
| Phthalazinone (color toning agent) (3% methanol solution) | 7 ml |
| Reducing Agent** (20% acetone solution) | 5 ml |

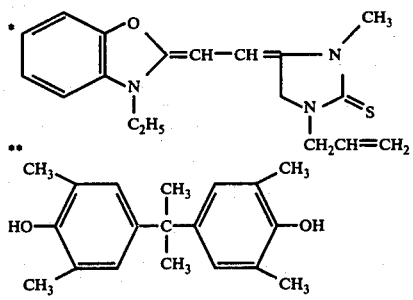

The resulting coating solution was coated on an art paper at a coverage of 0.4 g of silver per square meter to produce heat developable Light-Sensitive Material (F).

Heat developable Light-Sensitive Material (G) was prepared without the addition of $HgBr_2$ which was contained in the above composition. Light-Sensitive Materials (F) and (G) were exposed, and developed by heating under the same conditions as in Example 1. The following results were obtained.

| Heating Condition | Light-Sensitive Material (F) | Light-Sensitive Material (G) |
|---|---|---|
| 120° C for 40 sec | | |
| $D_{max}$ | 1.31 | 1.64 |
| $D_{min}$ | 0.15 | 0.13 |
| 140° C for 15 sec | | |
| $D_{max}$ | 1.21 | 1.52 |
| $D_{min}$ | 0.13 | 0.12 |

It can be seen that a mercury compound was not needed for reducing thermal fog, and that, the presence of the mercury compound was rather undesirable from the standpoint of $D_{max}$.

EXAMPLE 4

3.4 g of behenic acid was dissolved in 100 ml of benzene at 60° C., and the temperature of this solution was adjusted to 60° C. 100 ml of water was added to the above solution with stirring to form an emulsion. 100 ml of an aqueous solution of silver ammonium complex, which was prepared by adding aqueous to about 80 ml of an aqueous solution containing 1.7 g of silver nitrate, and then adding water to the aqueous solution to make the total volume one liter, was then added to the above emulsion. Crystallites of silver behenate were obtained.

The resulting dispersion was allowed to stand for 20 minutes at ordinary temperature, resulting in a separation into an aqueous phase and a benzene phase.

After the removal of the aqueous phase, the benzene phase was washed with 400 ml of water by decantation. 400 ml of methanol was further added to the benzene phase, from which silver behenate was collected by centrifugation. 4 g of spindle-like silver behenate having a length of 1 $\mu$ and a width of 0.05 $\mu$ was obtained. 2.5 g of silver behenate obtained herein was added to 20 ml of an isopropyl alcohol solution containing 2 g of polyvinyl butyral, and they were mixed in a ball-mill to prepare a polymer dispersion of the silver salt. A composition containing the components set forth in the following table were added to the polymer dispersion of silver behenate in their listed order every 10 minutes to result in the preparation of a heat developable light-sensitive composition.

| COMPOSITION | |
|---|---|
| Cobalt Nitrate (heat fog inhibitor) (0.04% methanol solution) | 5 ml |
| N-Bromoacetoamide (silver halide-forming component) (2.5% methanol solution) | 1 ml |
| Dye* (0.025% 2-methoxyethanol solution) | 1 ml |
| 2,2'-Methylenebis(6-t-butyl-4-methylphenol) (reducing agent) (20% acetone solution) | 3 ml |
| Phthalazinone (color toning agent) (2.5% 2-methoxyethanol solution) | 3 ml |
| Tetrabromophthalic Acid Anhydride (stabilizing agent) (0.6% methanol solution) | 1 ml |

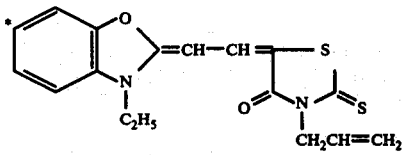

This heat developable light-sensitive composition was coated on a photographic paper at a coverage of 0.6 g silver per square meter to produce heat developable Light-Sensitive Material (H).

For the purpose of comparison with heat developable Light-Sensitive Material (H), heat developable Light-Sensitive Material (I) was prepared in the same manner as heat developable Light-Sensitive Material (H) except that cobalt nitrate was not added to the polymer dispersion of the silver behenate. Light-Sensitive Materials (H) and (I) were exposed, and developed by heating as in Example 1. Light-Sensitive Material (H) was hardly thermally fogged. On the other hand, Light-Sensitive Material (I) was markedly fogged by the heat developing process, so the gradations in the image were difficult to make out.

EXAMPLE 5

Heat developable Light-Sensitive Material (J) was prepared in the same manner as in Example 1 except that 0.03 g of nickel nitrate was used instead of cobalt nitrate and 0.13 g of N-bromoacetoamide was used instead of N-bromosuccinimide.

For the purpose of comparison with Light-Sensitive Material (J), heat developable Light-Sensitive Material (K) was prepared in the same manner as Light-Sensitive Material (J) except that nickel nitrate was not added.

These materials were exposed, and heat-developed as in Example 1. The results obtained are shown in the following table.

| Heating Condition | Light-Sensitive Material (J) | Light-Sensitive Material (K) |
|---|---|---|
| 120° C for 40 sec | | |
| $D_{max}$ | 1.48 | 1.43 |
| $D_{min}$ | 0.17 | 0.32 |
| 140° C for 15 sec | | |
| $D_{max}$ | 1.45 | 1.36 |
| $D_{min}$ | 0.16 | 0.35 |

It is apparent from the results in the above table that Light-Sensitive Material (J) was superior to Light-Sensitive Material (K).

EXAMPLE 6

A solution of 8.6 g of capric acid in 100 ml of butyl acetate was maintained at a temperature of 5° C., to which 200 ml of water was added with stirring to form an emulsion. 50 ml of an aqueous solution of silver ammonium complex containing 8.5 g of silver nitrate (chill-set at 5° C.) was added to the above emulsion over a 30 second period in order to allow the capric acid to react with the silver ion. After the removal of an aqueous phase, a silver caprate-containing butyl acetate phase was dispersed into 120 g of isopropanol solution containing 15 weight percent of polyvinyl butyral to produce a polymer dispersion of silver caprate. A composition containing the several components setforth below were added to the polymer dispersion of silver caprate in their listed order every ten minutes while maintaining the temperature at 50° C., resulting in the formation of a heat developable light-sensitive coating composition.

| COMPOSITION | |
|---|---|
| Cobalt Sulfte (heat fog inhibitor) (1% aqueous solution) | 5 ml |
| N-Bromoacetamide (silver halide forming agent) (2.5% methanol solution) | 24 ml |
| Tetrachlorotetrabromofluorescein (sensitizing dye) (0.025% methanol solution) | 72 ml |
| Phthalazinone (color toning agent) (2.5% 2-methoxyethanol solution) | 24 ml |
| Bisphenol A (reducing agent) (70 wt% 2-methoxyethanol solution) | 72 ml |
| Lauric Acid (stabilizing agent) (5 wt% methanol solution) | 50 ml |

The resulting coating composition was coated on a supporting paper at a coverage of 1.0 g silver per square meter. Thus, heat developable Light-Sensitive Material (L) was obtained. In addition, heat developable Light-Sensitive Material (M) was prepared in the same manner as Light-Sensitive Material (L) except that cobalt sulfate was not added.

These two kinds of sensitive materials were exposed to light from a tungsten lamp through an original having gradations, and developed by heating at a temperature of 120° C. for 20 seconds. Light-Sensitive Material (L) formed a contrasty image, while Light Sensitive Material (M) was so greatly fogged by heating that the image thereof was hardly detected.

EXAMPLE 7

Heat developable Light-Sensitive Material (N) was prepared in the same manner as in Example 1 except that 0.05 g of ferric nitrate was employed instead of cobalt nitrate, the coating amount of silver was 1.2 g per square meter, and a polyethylene terephthalate film was used instead of a supporting paper. In addition, heat developable Light-Sensitive Material (O) was prepared in the same manner as the above Light-Sensitive Material (N) except that ferric nitrate was not added.

These materials were exposed and heat developed in the same manner as in Example 1. Light-Sensitive Material (O) had a higher amount of fog than Light-Sensitive Material (N).

EXAMPLE 8

1.9 g of sodium hydroxide was dissolved in 200 ml of water. 100 ml of toluene containing 12 g of lauric acid was added to the above aqueous solution with stirring to form an emulsion. The stirring (800 rpm) was continued for 5 minutes, and then an aqueous solution of silver nitrate (containing 8.5 g of silver nitrate and 50 ml of water) was added to the emulsion with stirring over a 60 second period. After the collection of the silver laurate precipitated, 30 g of polyvinyl butyral and 200 ml of ethanol were added to the silver laurate precipitate, and then the mixture was mixed with a ball-mill to prepare a polymer dispersion of silver laurate. 0.01 g of cobalt nitrate was added to 50 g of this dispersion, and then, stirring was continued for 20 minutes at temperature of 30° C. 6 ml of a 3% acetone solution of N-bromophthalazinone was further added, followed by stirring for 3 hours at a temperature of 30° C. After the addition of the components set forth below to the dispersion at a temperature of 30° C., the dispersion was coated on a support paper at a coverage of 0.5 g silver per square meter to form heat developable Light-Sensitive Material (P). For the purpose of comparison, Light-Sensitive Material (Q) was prepared in the same manner as Light-Sensitive Material (P) except that cobalt nitrate was not added.

| COMPOSITION | |
|---|---|
| Dye* (0.025% 2-methoxyethanol solution) | 2 ml |
| Phthalazinone (color toning agent) (3% methanol solution) | 7 ml |
| Reducing Agent** (20% acetone solution) | 5 ml |

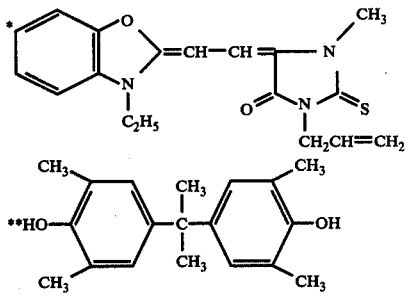

These materials were exposed and heat developed in the same manner as in Example 1. Light-Sensitive Material (P), as well as Light-Sensitive Material (A) prepared in Example 1, had much more reduced thermal fog, compared with Light-Sensitive Material (Q).

EXAMPLE 9

Light-Sensitive Material (R) was prepared in the same manner as in Example 1 except that 5 ml of a 0.5% methanol solution of trisacetylacetonatocobalt (III) complex, $[Co(acac)_3]$ was added instead of cobalt nitrate. Both Light-Sensitive Material (R) and Light-Sensitive Material (B), which was prepared separately and did not contain the above cobalt complex, were exposed through a wedge, followed by heat development at a temperature of 140° C. for 15 seconds. Both Light-Sensitive Materials (R) and (B) had good images in their exposed areas. On the other hand, the unexposed areas of Light-Sensitive Material (R) was hardly fogged by heating ($D_{min}$ = 0.20) but the unexposed area of Light-Sensitive Material (B) was fogged by heating ($D_{min}$ = 0.39). These results indicate that the above complex of trivalent cobalt was effective for preventing thermal fog.

EXAMPLE 10

The trivalent cobalt complex, tris(3-bromoacetylacetonato)cobalt (III), $[Co(C_5H_6BrO_4)_3]$ was employed instead of cobalt nitrate in Example 1. The addition amount was 5 ml of a 0.1% methanolic solution. The procedures for the preparation of the light-sensitive material after the above procedure were the same as in Example 4. Thus, Light-Sensitive Material (S) was obtained. Light-Sensitive Material (S) and Light-Sensitive Material (B) prepared in Example 1 were exposed through a wedge, and heat-developed under different conditions; at 120° C. for 40 sec, and at 140° C. for 12 sec. The results obtained are shown in the following table.

| Heating Condition | Light-Sensitive Material (B) | Light-Sensitive Material (S) |
|---|---|---|
| 120° C for 40 sec | | |
| $D_{max}$ | 1.38 | 1.48 |
| $D_{min}$ | 0.35 | 0.17 |
| 140° C for 12 sec | | |
| $D_{max}$ | 1.24 | 1.37 |
| $D_{min}$ | 0.37 | 0.18 |

These results indicate that Light-Sensitive Material (S) had less thermal fog than Light-Sensitive Material (B), and the above cobalt complex was effective for prevention of thermal fog.

EXAMPLE 11

0.2 g of tris(8-oxyquinolato)cobalt (III) was used instead of cobalt nitrate in Example 1. The procedures for the preparation of the light-sensitive material after the above procedure were the same as in Example 5. Thus, heat developable Light-Sensitive Material (T) was obtained. The photographic properties of Light-Sensitive Material (T) were compared with those of Light-Sensitive Material (K) which was prepared without adding the above cobalt compound. These materials were exposed and heat-developed in the same manner as in Example 1.

The results obtained herein indicate that the above cobalt complex was effective for prevention of thermal fog because Light-Sensitive Material (T) had less thermal fog than Light-Sensitive Material (K).

EXAMPLE 12

5 ml of a 0.5% acetone solution of tris-(acetylacetonato)iron (III), $[Fe(acac)_3]$, was employed instead of the cobalt complex used in Example 9. Light-Sensitive Material (U) which was prepared in the same manner as in Example 1 except the photographic properties were examined in the manner of Example 9. The photographic properties of Light-Sensitive Material (U) were as good as those of Light-Sensitive Material (R). The iron complex employed herein proved to be effective for prevention of thermal fog.

EXAMPLE 13

5 ml of a 0.3% methanol solution of tris-(acetylacetonato)nickel (II), $[Ni(acac)_2]$, was used instead of the cobalt complex used in Example 9. Light-Sensitive Material (V) which was prepared in the same maner as in Example 1 except the photographic properties were examined in the manner of Example 9. The photographic properties of Light-Sensitive Material (V) were as good as those of Light-Sensitive Materials (R) and (U). The above nickel complex was found to be effective for prevention of thermal fog.

REFERENCE EXAMPLE 1

The addition order of N-bromosuccinimide and cobalt nitrate in Example 1 was changed. Namely, after the addition of the N-bromosuccinimide to the polymer dispersion of the silver salt, stirring was continued for 90 minutes at a temperature of 50° C., followed by the addition of cobalt nitrate. Stirring was continued for 20 minutes. Heat developable Light-Sensitive Material (W) was prepared in the same manner as in Example 1 except for the above-described differences. This material was exposed in the same manner as in Example 1, and heat-developed at a temperature of 120° C. for 40 seconds. The results obtained are set forth below.

| Heating Condition | Light-Sensitive Material (A) | Light-Sensitive Material (B) | Light-Sensitive Material (W) |
|---|---|---|---|
| 120° C for 40 sec | | | |
| $D_{max}$ | 1.49 | 1.38 | 1.49 |
| $D_{min}$ | 0.16 | 0.35 | 0.29 |

These results shown the addition time of cobalt nitrate to be important.

REFERENCE EXAMPLE 2

N-bromosuccinimide was not added in Example 9. Light-Sensitive Material (X) was prepared in the same manner as in Example 9 except for the above treatment. Although Light-Sensitive Material (X) was exposed and heated in the same manner as in Example 1, images could not be obtained. Therefore, a silver halide-forming component such as N-bromo-succinimide was found to be greatly effective for increasing the sensitivity.

While the invention has been described in detail and with reference to specific embodiments thereof, it will be apparent to one skilled in the art that various changes and modifications can be made therein without departing from the spirit and scope thereof.

What is claimed is:

1. A heat developable light-sensitive material comprising a support having thereon at least one layer and containing as essential components (a) an organic silver salt, (b) 0.001 mol to 0.5 mol per mol of organic silver salt of at least one N-halo compound capable of forming a light-sensitive silver halide by reaction with said organic silver salt and (c) a reducing agent, and with at least one layer containing (d) an iron family compound which prevents thermal fog selected from the group consisting of iron (II) nitrate, iron (III) nitrate, iron (II) acetate, iron (III) acetate, iron (II) formate, iron (III) formate, iron (II) sulfate, iron (III) sulfate, iron (II) perchlorate, iron (III) perchlorate, cobalt (II) nitrate, cobalt (III) nitrate, cobalt (II) acetate, cobalt (III) acetate, cobalt (II) formate, cobalt (III) formate, cobalt (II) sulfate, cobalt (III) sulfate, cobalt (II) perchlorate, cobalt (III) perchlorate, nickel (II) nitrate, nickel (II) acetate, nickel (II) formate, nickel (II) perchlorate and mixtures thereof or a complex compound of iron, cobalt or nickel said iron family compound being present in an amount of about $10^{-5}$ mole to $10^{-1}$ mole per mole of the organic silver salt (a).

2. The heat-developable light-sensitive material of claim 1, wherein said organic silver salt is a silver salt of a compound containing an imino group, a mercapto group, a hydroxy group or a carboxy group.

3. The heat-developable light-sensitive material of claim 2, wherein said organic silver salt is a silver salt of a compound containing a carboxy group.

4. The heat-developable light-sensitive material of claim 3, wherein said organic silver salt is a monocarboxylic higher fatty acid silver salt.

5. The heat-developable light-sensitive material of claim 1, wherein said light-sensitive silver halide is selected from the group consisting of silver chloride, silver bromide, silver bromoiodide, silver iodobromochloride, silver bromochloride, silver iodochloride, silver iodide and a mixture thereof.

6. The heat developable light-sensitive material of claim 1, wherein said reducing agent is a compound selected from the group consisting of a substituted phenol, an unsubstituted bisphenol, a substituted bisphenol, an unsubstituted bisnaphthol a substituted bisnaphthol, a dihydroxynaphthalene, a poly-hydroxynaphthalene, a di-hydroxybenzene, a poly-hydroxybenzene, a hydroquinone monoether, ascorbic acid, a derivative of ascorbic acid, a photolytic reducing agent, a 3-pyrazolidone, a pyrazolone, a reducing saccharide, p-oxyphenyl glycine, hydroxytetronic acid, N,N-di(2-ethoxyethyl)hydroxylamine, an N,N-dialkyl-p-phenylenediamine, 5,7-dihydroxy-4-methylcoumarin, kojic acid, hinokitiol and a mixture thereof.

7. The heat-developable light-sensitive material of claim 1, wherein said iron family compound has a solubility in water of greater than about 0.01 g/100 ml of water at 25° C.

8. The heat-developable light-sensitive material of claim 1, wherein said iron family compound is a complex compound of iron, cobalt or nickel.

9. The heat-developable light-sensitive material of claim 8, wherein said complex compound is a coordination compound comprising a central iron, cobalt or nickel atom and a ligand in which the coordinating atoms include at least one atom selected from the group consisting of a halogen atom, a nitrogen atom, an oxygen atom, a sulfur atom, a phosphorus atom, an arsenic atom, and a mixture thereof.

10. The heat-developable light-sensitive material of claim 14, wherein said ligand is selected from the group consisting of a $\beta$-diketone, an oxime, an oxine, a dithiocarbamine, salicylic acid, picolinic acid, and a mixture thereof.

11. A method of forming an image comprising imagewise exposing the heat-developable light-sensitive material of claim 1, and heating said exposed light-sensitive material.

12. The heat-developable light-sensitive material of claim 1, wherein said material comprises said support having thereon said at least one layer and consists essentially of said components (a) to (d).

13. The heat developable light-sensitive material of claim 1, wherein said N-halo compound is represented by the general formulae (I) and (II)

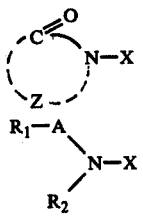

(I)

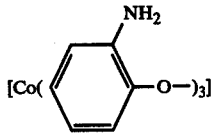

(II)

wherein X represents a halogen atom such as chlorine, bromine and iodine; Z represents an atomic group required for the formation of a 5- or 6-membered ring, which may condense with another ring; A represents a carbonyl group or a sulfonyl group; and $R_1$ and $R_2$ each represents an alkyl group, an aryl group or an alkoxy group.

14. The heat-developable light-sensitive material of claim 1, wherein said complex of iron, cobalt or nickel is an inner complex wherein the minus charge attributable to the electro-negative ligands and plus charge attributable to iron, cobalt or nickel compensate for each other and the coordinating sphere thereof becomes electrically neutral.

15. The heat-developable material of claim 1, wherein said iron family compound (d) is selected from the group consisting of cobalt nitrate, nickel nitrate and iron nitrate.

16. The heat-developable light-sensitive material of claim 1, wherein said complex of iron, cobalt or nickel is selected from the group consisting of $[Fe(dtc)_3]$
$[Fe(dtp)_3]$
$[Fe(acac)_3]$
$[Fe(oxin)_3]$
$[FeN(CH_2CH_2O)_3]$
$[Fe(bipy)_3](ClO_4)_3.3H_2O$
$[Fe(o\text{-}phen)_3](ClO_4)_3$
$[Fe(urea)_6](ClO_4)_3$
$(NH_4)_3[Fe(ox)_3]$
$[Fe(py)_4](ClO_4)_3$
$Na[Fe(edta)].3H_2O$
$K_3[Fe(sal)_3]$
$Fe(NH_3)_6](ClO_4)_3$
$[Fe(oxin)_2]$
$[Fe(dmg)_2Py_2]$
$[Fe(C_6H_5NH_2)_2Cl_2]$
$[Fe(bipy)_3]SO_4$
$[Ni(oxin)_2].2H_2O$
$Ni(acac)_2$
$Ni(3\text{-}Br\text{-}acac)_2$
$Ni(H_2edta)$
$Ni(gly)_2$
$Ni(NH_2OH)_4(NO_3)_2$
$[Co(acac)_2]$
$[Co(NH_3)_6](NO_3)_3$
$[Co(en)_3](NO_3)_3$
$[Co(py)_6](NO_3)_3$
$[Co(bipy)_3](NO_3)_3$
$[Co(o\text{-}phen)_3](NO_3)_3$
$K_3[Co(CN)_6]$
$[Co(acac)_3]$
$[Co(gly)_3]$
$[Co(exan)_3]$
$[Co(dtc)_3]$
$[Co(oxin)_3]$ $[Ni(NH_3)_6](ClO_4)_2$ $[Ni(en)_3](ClO_4)_2$
$[Ni(py)_6](ClO_4)_2$
$[Ni(py)_4Cl_2]$
$[Ni(bipy)_3](NO_3)_2$
$[Ni(o\text{-}phen)_2](NO_3)_2$.

17. The heat-developable light-sensitive material of claim 14, wherein said inner complex is $[Fe(dtc)_3]$, $[Fe(dtp)_3]$, $[Fe(acac)_3]$, $[Fe(oxin)_3]$, $[FeN(CH_2CH_2O)_3]$, $[Fe(oxin)_2]$, $[Fe(dmg)_2Py_2]$, $[Fe(C_6H_5NH_2)_2Cl_2]$, $K_3[Co(CN)_6]$, $[Co(acac)_3]$, $[Co(gly)_3]$, $[Co(exan)_3]$, $[Co(dtc)_3]$, $[Co(oxin)_3]$,

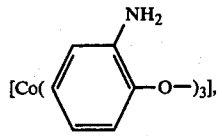

$[Co(acac)_2]$, $[Ni(py)_4Cl_2]$, $Ni(acac)_2$, $Ni(3\text{-}Br\text{-}acac)_2$, $Ni(H_2edta)$, $Ni(gly)_2$.

18. The heat-developable light-sensitive material of claim 13, wherein said 5 or 6-membered ring formed by Z is selected from the group consisting of a pyrrole ring, a pyrroline ring, a pyrrolidine ring, an imidazoline ring, an imidazolidine ring, a pyrazoline ring, a pyrazolidine ring, a piperidine ring, an oxazine ring, a thiazine ring, a piperazine ring, a hydantoin ring, a cyanuric acid ring, a thiohydantoin ring and an indoline ring.

19. The heat-developable light-sensitive material of claim 13, wherein said aryl group is an unsubstituted or substituted phenyl or naphthyl.

20. The heat-developable light-sensitive material of claim 1 wherein said N-halo compound is selected from the group consisting of N-Bromosuccinimide,
N-Bromotetrafluorosuccinimide,
N-Bromophthalimide,
N-Bromoglutarimide,
1-Bromo-3,5,5-trimethyl-2,4-imidazolidinedione,
1,3-Dibromo-5,5-dimethyl-2,4-imidazolidinedione,
N,N'-Dibromo-5,5-diethylbarbituric acid,
N,N'-Dibromobarbituric acid,
N-Bromoisocyanuric acid,
N-Bromoacetamide,
N-Bromochloroacetamide,
N-Bromotrifluoroacetamide,
N-Bromoacetanilide,
N-Bromobenzenesulfonylanilide,
N-Bromobenzamide,
N-Bromobenzenesulfonylamide,
N-Bromo-N-benzenesulfonylbenzenesulfonylamide,
N-Bromophthalazone,
N-Chlorosuccinimide,
N-Iodosuccinimide,
Trichloroisocyanuric acid,
N-Chlorophthalimide,
1,3-Dichloro-5,5-dimethyl-2,4-imidazolidinedione,
3-Chloro-5,5-dimethyl-2,4-imidazolidinedione,
1,3-Dichloro-5,5-dimethyl-2,4-imidazolidinedione,
Trichloromelamine,
Tribromomelamine,
N-Bromocyclohexanedicarbonimide,
1-Bromo-3,5,5-triethyl-2,4-imidazolidinedione,
1-Bromo-3-ethyl-5,5-dimethyl-2,4-imidazolidinedione,
1,3-Dibromo-5,5-diethyl-2,4-imidazolidinedione,
N,N-Dibromo-5,5-dimethylbarbituric acid,
N,N-Dibromo-5-ethyl-5-methylbarbituric acid,
N,N-Dibromo-5-ethyl-5-phenylbarbituric acid,
N,N'-Dibromoisocyanuric acid,
N-Bromoacetamide,
N-Bromonaphthamide,
N-Bromohydroxybenzamide,
N-Bromocarboxybenzamide,
N-Bromotoluenesulfonamide,
N-Bromo-N-toluenesulfonyltoluenesulfonylamide,
1-Bromo-3,5,5-trimethyl-2,4-imidazolidinedithione,
1-Bromo-3,5,5-triethyl-2,4-imidazolidinedithione,
1-Bromo-3-ethyl-5,5-dimethyl-2,4-imidazolidinedithione,
1,3-Dibromo-5,5-dimethyl-2,4-imidazolidinedithione,
1,3-Dibromo-5,5-diethyl-2,4-imidazolidinedithione,
1,3-Dichloro-5,5-dimethyl-2,4-imidazolidinedithione,
3-Chloro-5,5-dimethyl-2,4-imidazolidinedithione,
1,3-Diiodo-5,5-dimethyl-2,4-imidazolidinedithione, and
N-Bromosaccharin.

21. In a process of producing the heat-developable light-sensitive material which comprises (1) reacting (a) an organic silver salt and (b) 0.001 mol to 0.5 mol per mol of organic silver salt of at least one N-halo compound (2) adding (c) a reducing agent to the reaction product of step (1), and (3) coating said mixture on a support, the improvement comprising adding (d) an iron family compound to said organic silver salt before or during said reaction (1), wherein said iron family compound prevents thermal fog and is selected from the group consisting of iron (II) nitrate, iron (III) nitrate, iron (II) acetate, iron (III) acetate, iron (II) formate, iron (III) formate, iron (II) sulfate, iron (III) sulfate, iron (II) perchlorate, iron (III) perchlorate, cobalt (II) nitrate, cobalt (III) nitrate, cobalt (II) acetate, cobalt (III) acetate, cobalt (II) formate, cobalt (III) formate, cobalt (II) sulfate, cobalt (III) sulfate, cobalt (II) perchlorate, cobalt (III) perchlorate, nickel (II) nitrate, nickel (II) acetate, nickel (II) formate, nickel (II) perchlorate and mixtures thereof or a complex compound of iron, cobalt or nickel said iron family compound being present in an amount of about $10^{-5}$ mole to $10^{-1}$ mole per mole of the organic silver salt (a).

22. The heat-developable light-sensitive material of claim 13, wherein said aryl group is substituted with an alkyl group containing 1 to 4 carbon atoms.

23. The heat-developable light-sensitive material of claim 13, wherein said alkoxy group has 1 to 8 carbon atoms.

* * * * *